US005457663A

United States Patent [19]

Mejaski

[11] Patent Number: 5,457,663

[45] Date of Patent: Oct. 10, 1995

[54] ASTRONOMICAL TIME CLOCKS

[76] Inventor: Stephen G. Mejaski, 617 Main St., Royersford, Pa. 19468

[21] Appl. No.: 164,862

[22] Filed: Dec. 10, 1993

[51] Int. Cl.[6] ..... G04B 19/26; G04B 19/22; G04B 19/24

[52] U.S. Cl. ..... 368/15; 368/23; 368/28; 368/29; 368/82

[58] Field of Search ..... 368/15–21, 23, 368/28–30, 82, 223, 228, 239

[56] References Cited

U.S. PATENT DOCUMENTS

| | | | |
|---|---|---|---|
| D. 48,658 | 2/1916 | Vaipan . | |
| D. 98,049 | 8/1935 | Blow . | |
| D. 105,766 | 12/1936 | Rodanet . | |
| D. 145,961 | 8/1945 | Tellier | D42/7 |
| D. 187,608 | 4/1960 | Merrigan . | |
| D. 254,124 | 2/1980 | Greenfield | D10/6 |
| D. 256,781 | 9/1980 | Mackery | D10/6 |
| D. 275,840 | 10/1984 | Rhetts | D10/6 |
| D. 301,308 | 5/1989 | Ray | D10/6 |
| 521,725 | 6/1894 | Molesworth . | |
| 3,766,727 | 10/1973 | Didik | 58/3 |
| 4,435,795 | 3/1984 | Frank | 368/16 |
| 4,583,864 | 4/1986 | Graves | 368/17 |
| 4,671,669 | 6/1987 | Graves | 368/17 |
| 4,731,767 | 3/1988 | Uehara | 368/15 |
| 5,197,043 | 3/1993 | Strader | 368/27 |

*Primary Examiner*—Vit W. Miska
*Attorney, Agent, or Firm*—Michael F. Petock

[57] ABSTRACT

An astronomical time clock has a clock face divided into twelve segments representing the months of the year and a centrally positioned light which represents the sun. A globe representing the Earth rotates by a drive means around the light and is positioned in the segment representing the current month. The time of the day may be displayed by conventional clock hands or a digital display which is made clearly visible only in the segment corresponding to the current month. In a preferred embodiment, the globe rotates on its axis representing night and day and may be provided with tilt representing the seasons of the year.

25 Claims, 8 Drawing Sheets

ASTRONOMICAL TIME CLOCKS

FIELD OF THE INVENTION

The present invention relates to astronomical time clocks. More particularly, the present invention relates to several embodiments of astronomical time clocks which provide illustrated information on rotation and travel of the Earth, and star constellations visible during different months of the year.

BACKGROUND OF THE INVENTION

For centuries the differing star constellations in the sky at night have intrigued people. In the last four or five centuries, scientist and the general population have come to have an understanding of the manner in which the Earth rotates on its axis and travels around the sun. This information for each month and day of the year is quite interesting for many people. The time of day, day of the month requires information which is practically essential for the functioning of most people.

Various attempts have been made in the past to provide some apparatus which provide some information on some aspect of astronomy, for example see U.S. Pat. No. 3,766,727—Didik which discloses a planet time clock which illustrates the arrangement of various planets as well as providing a time clock. U.S. Pat. No. 4,435,795—Frank discloses a celestial clock and U.S. Pat. No. 4,671,669—Graves discloses a solar system clock. However, none of these disclose a clock similar to those disclosed herein.

SUMMARY OF THE INVENTION

The present invention provides advantages of displaying not only the time of day, either digitally or by clock hands, but also provides an indication of the day of the week, date, month and year. Further, the orbital position of the Earth around the sun in reference to the constellation of stars which is normally visible in the night sky is readily displayed. Furthermore, the present invention provides a display of the Earth or World as it is illuminated by the sun utilizing a light bulb and a globe representing the Earth which both rotates and maintains a predetermined tilt on its axis corresponding to night, day and the seasons.

Briefly and basically, in accordance with the present invention, a time clock is provided which has a clock face. The clock face is divided into twelve segments representing the months of the year. Means is provided for displaying the time of day which may be either a digital display or clock hands. A globe representing the Earth is rotatably positioned by a drive means in the segment representing the current month. A light is positioned substantially in the center of the clock face and means for rotating the globe on its axis is provided so that approximately half of the globe is illuminated by the light in a manner corresponding to day light and the unilluminated portion corresponding to night time.

In an optional, but preferred embodiment, the axis of the globe is also tilted to correspond to the seasons. The globe is synchronized with the digital display so that only the digital display located in the segment for the current month is the one that is made visible.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
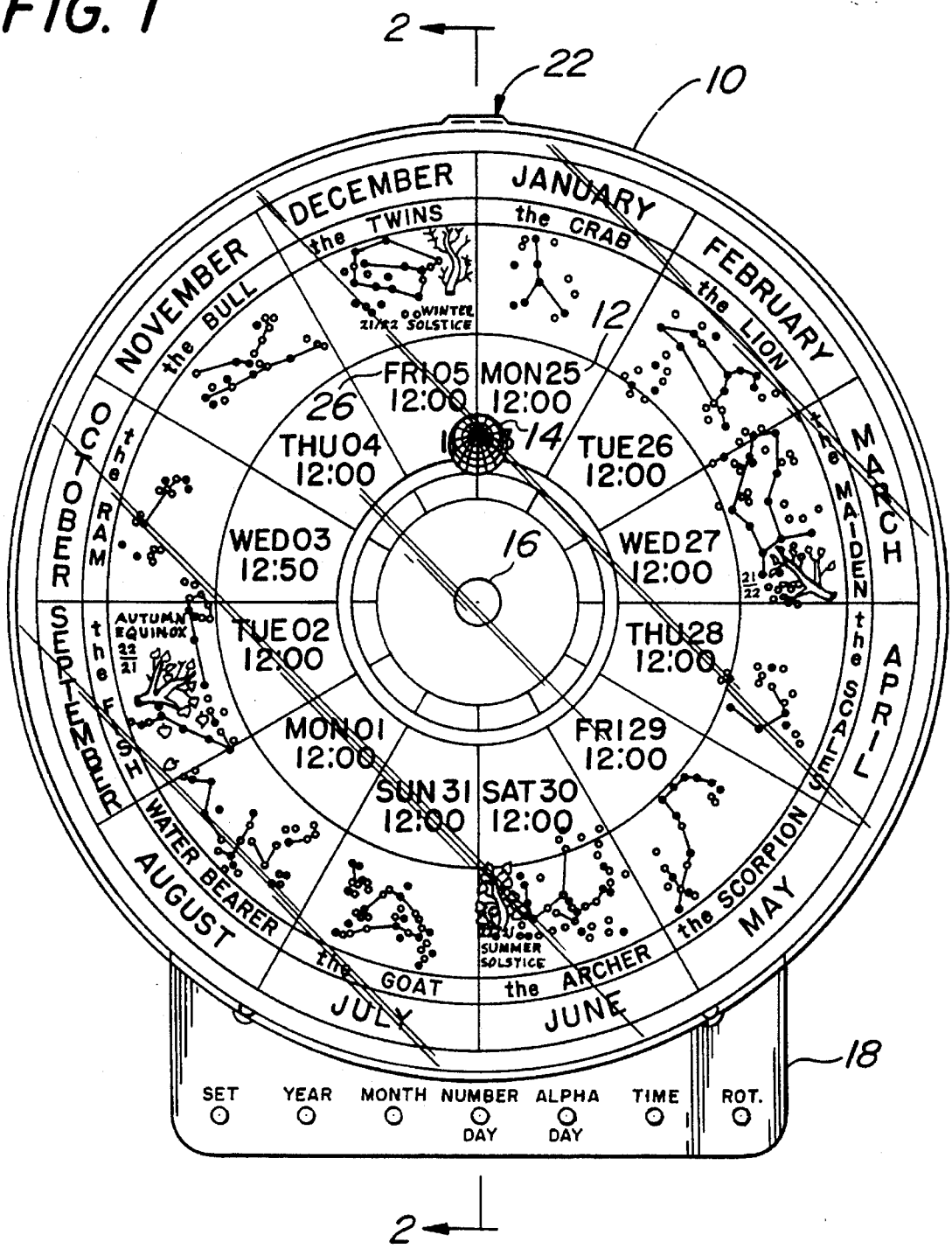
FIG. 1 is a front elevation view of an astronomical time clock in accordance with the present invention.

Referring now to the drawings wherein like numerals indicate like elements, there is shown in FIG. 1 a front elevation view of an astronomical time clock 10 in accordance with the present invention. As may be best seen from FIG. 1, the face of clock 10 is divided into twelve segments each identified with one of the twelve months January through December. Each segment is labeled with a particular month and bears a representation of the star constellation which is normally visible in the northern hemisphere during that particular month. Certain months may have additional representations such as the months representing the change of seasons wherein for example, the month of March illustrates a tree with budding whereas September has an illustration of a tree with leaves falling therefrom. Similarly, June has a representation of a tree in full bloom and December has a representation of a barren tree representing winter.

Each segment is also provided with a digital display. For example, the segment for January is provided with digital display 12 which illustrates the day of the week, the numerical day of the month and the time. Although each segment has a digital display, only the digital display for the particular month is made clearly visible such as by energization of the digital display which may be made up of light emitting diodes or other suitable display means, or by some other form of illumination of the particular digital display.

The clock face is also provided with a globe 14 representing the Earth or the World. Globe 14 bears representations on its surface of continents, oceans and other common representations found on geographical globes. Globe 14 rotates on its own axis and also, during the period of a year, it travels completely around a centrally disposed light 16 which represents the sun.

A control panel 18 is provided on the astronomical time clock 10 for setting the year, month, numerical day, alphabetical day, time and for rotating the globe 14 to correspond to its proper rotational position depending upon the particular time zone in which the person utilizing the clock is located.

Figure 2:
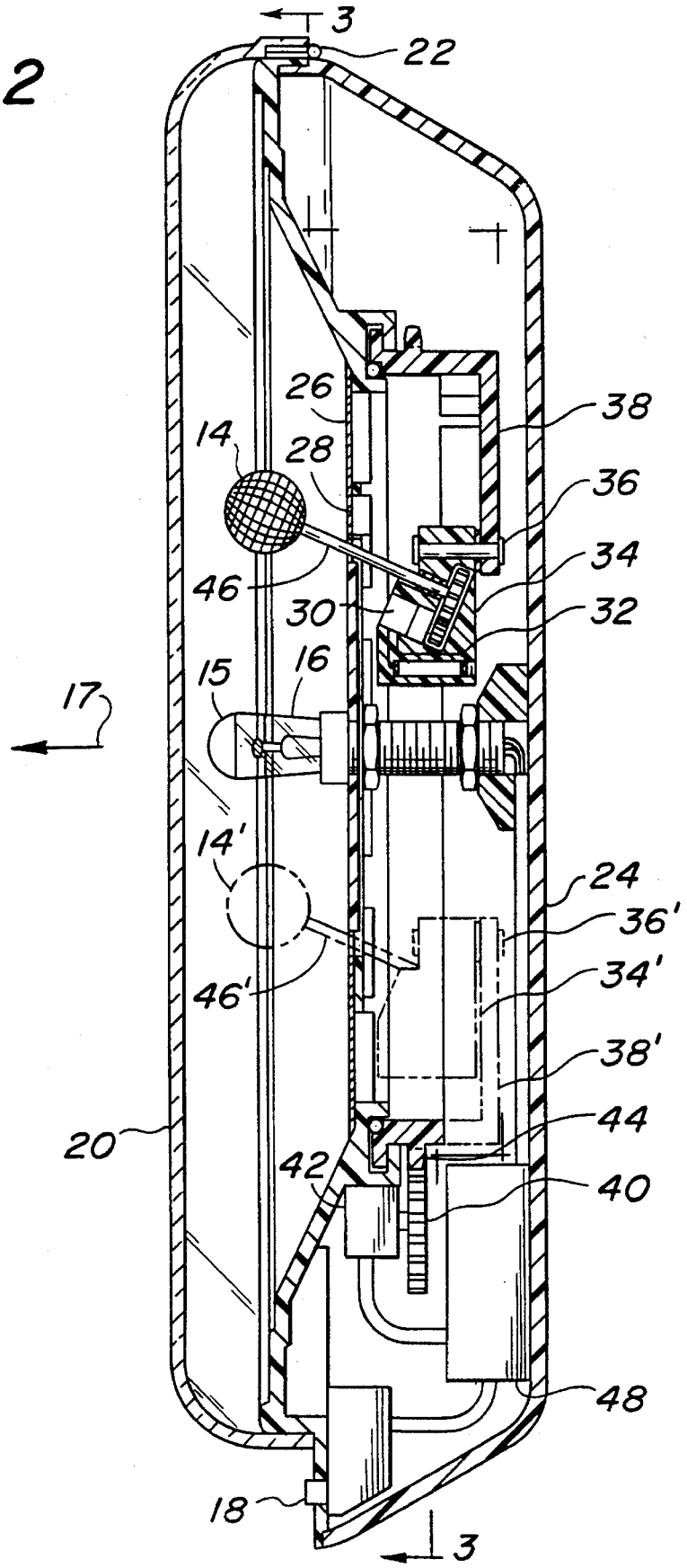
FIG. 2 is a cross-sectional view taken along line 2—2 of FIG. 1.

As may be best seen in FIG. 2, astronomical time clock 10 is provided with a transparent front cover 20 which may be hinged as illustrated at 22 to enable opening to replace light bulb 16 and the like. Light bulb 16 may be provided with a light shield 15 to prevent or reduce light emission into the viewer's eyes, that is in the direction of arrow 17. This shield 17 may be constructed of any suitable opaque or partially opaque material, and may be a coating 15 on light bulb 16.

The clock is mounted within a housing 24 which may be wall mounted or mounted on a table at a small selected angle from the vertical, such as fifteen (15°) degrees. However, it is understood that greater or lesser angles may be selected. There is shown in FIG. 2 the digital display 26 for reading out the day both alphabetically (day of the week) and numerically (day of the month) as well as the time. In addition, as may be better seen in FIG. 2, there is a display 28 for reading out the year, which is partially obstructed by globe 14 in FIG. 1.

Figure 3:
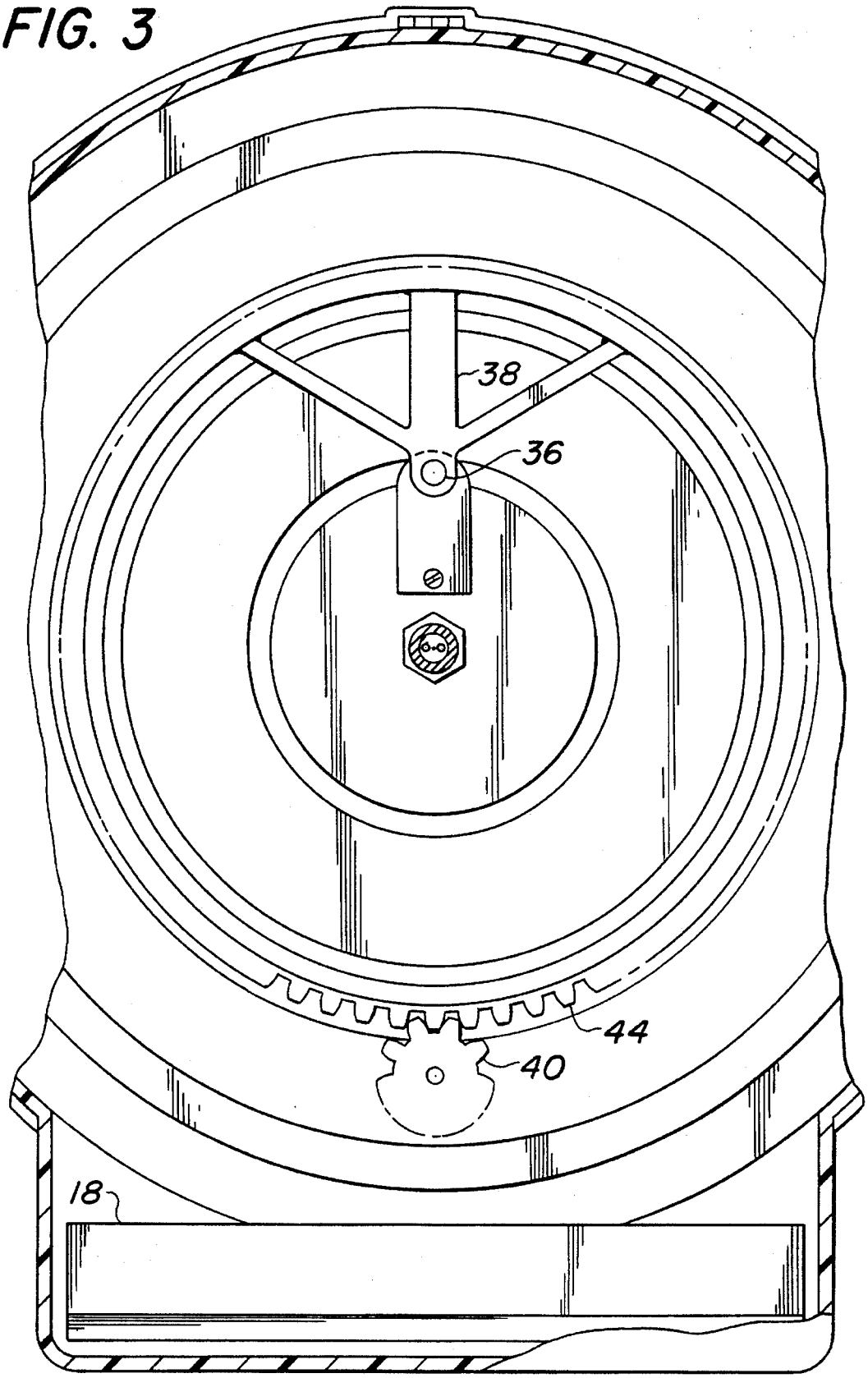
FIG. 3 is a broken away cross-sectional view taken along line 3—3 of FIG. 2.

As may be best seen in FIG. 2, globe 14 is caused to rotate on its axis by a motor 30 which may be powered by a battery 32. Motor 30 is carried in a pivoted housing 34 which pivots on pivot pin 36. Gravity causes pivoted housing 34 to always depend in a vertical or plumb position i.e., battery 32 at the lowest position, as shown in FIG. 2. Housing 34 carried by pivot pin 36 is in turn carried by suspension frame 38, a back plan view of which may be seen in FIG. 3. Frame 38 is caused to rotate behind the clock face once per year by means of gear 40, driven by motor 42, which drives gearing 44 connected to frame 38. The axis 46 of globe 14, as best illustrated in FIG. 2, maintains an angle or tilt of approximately twenty-three and one half degrees to the north visa vie the longitudinal axis of bulb 16, or in other words approximately twenty-three and one half degrees (23½°) from a line perpendicular to the face of the clock i.e., in the direction of arrow 17. This represents the tilt of the Earth on the Earth's axis which results in the seasons experienced in the northern and southern hemispheres during the year. This tilt or angle of twenty-three and one half degrees (23½°) is maintained in the vertical or upwardly direction as a result of the housing 34 always remaining plumb or arranged in an upwardly pointing direction as the frame 38 rotates through the three hundred and sixty degrees (360°) during the period of one year. The maintenance of this tilt or angle of twenty-three and one half degrees (23½°) is illustrated for the lower most position in dotted lines in the lower portion of FIG. 2 wherein the globe bears the numeral 14' with an axis of 46' as it is carried by housing 34'. As may be seen the frame 38' now points upwardly with pivot pin 36' being held in an upper position (the frame 38 at this point is in an upwardly directed orientation).

There is also illustrated in FIG. 2 a transformer and electronic control unit 48. Unit 46 includes a transformer which reduces the voltage from typically one hundred ten (110) volts to a lower suitable voltage such as twelve (12) volts, nine (9) volts or twenty-four (24) volts for use in the integrated circuits, transistors circuits and the like utilized in the controls, time keeping and display circuitry.

Figure 4:
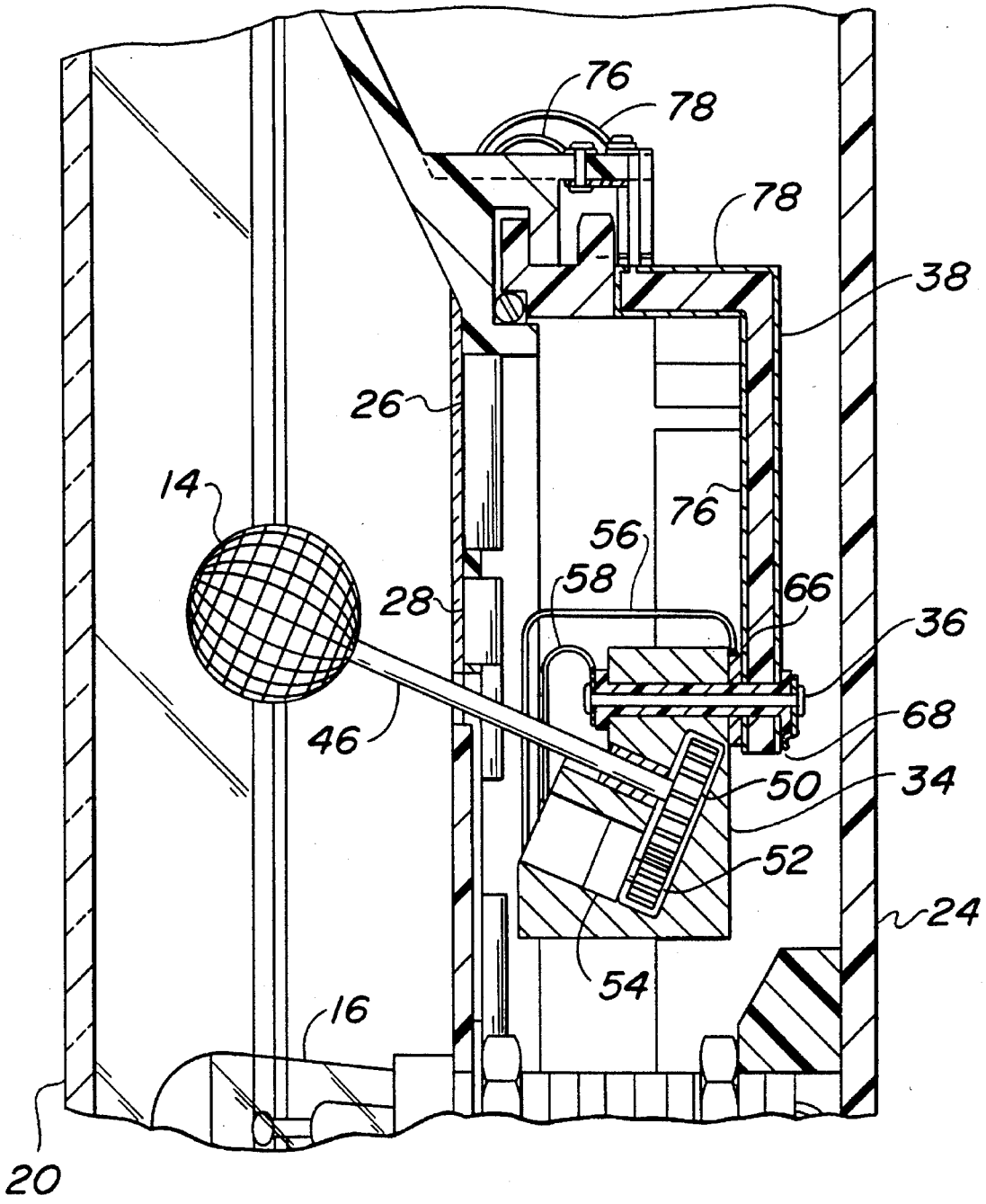
FIG. 4 is a broken away cross-sectional view illustrating one embodiment of a rotational drive for the globe maintaining a predetermined tilt.

Referring now to FIG. 4, there is shown an alternate embodiment of a drive system for rotating globe 14 which does not require a battery. Globe 14 is caused to rotate on its axis by gears 50 and 52 which are driven by motor 54. Motor 54 may be an alternating current or a direct current motor which is supplied electricity via conductors 56 and 58 which are fed through slip rings or contact connectors 66 and 68, respectively. Slip ring connectors 66 and 68 are connected to an electrical source via electrical conductors 76 and 78, respectively. In other respects, the embodiment shown in FIG. 4 is substantially identical to the structure shown in FIG. 2, namely a pivoted housing 34 suspended by means of pivot pin 36 from a suspension frame 38 which is caused to rotate one revolution per year.

Figure 5:
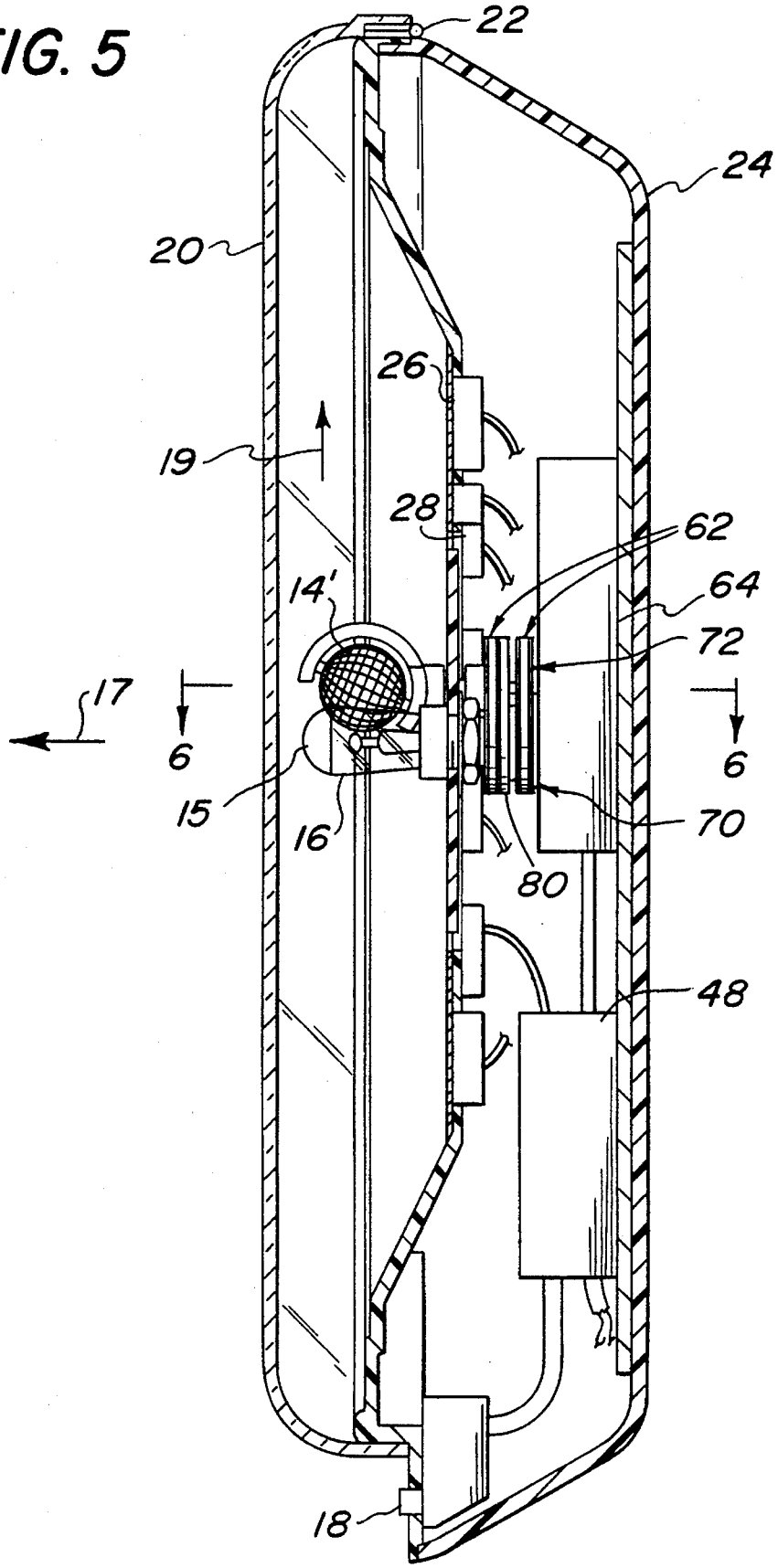
FIG. 5 is a cross-sectional view of another embodiment illustrating another embodiment of the drive for the globe.
Figure 6:
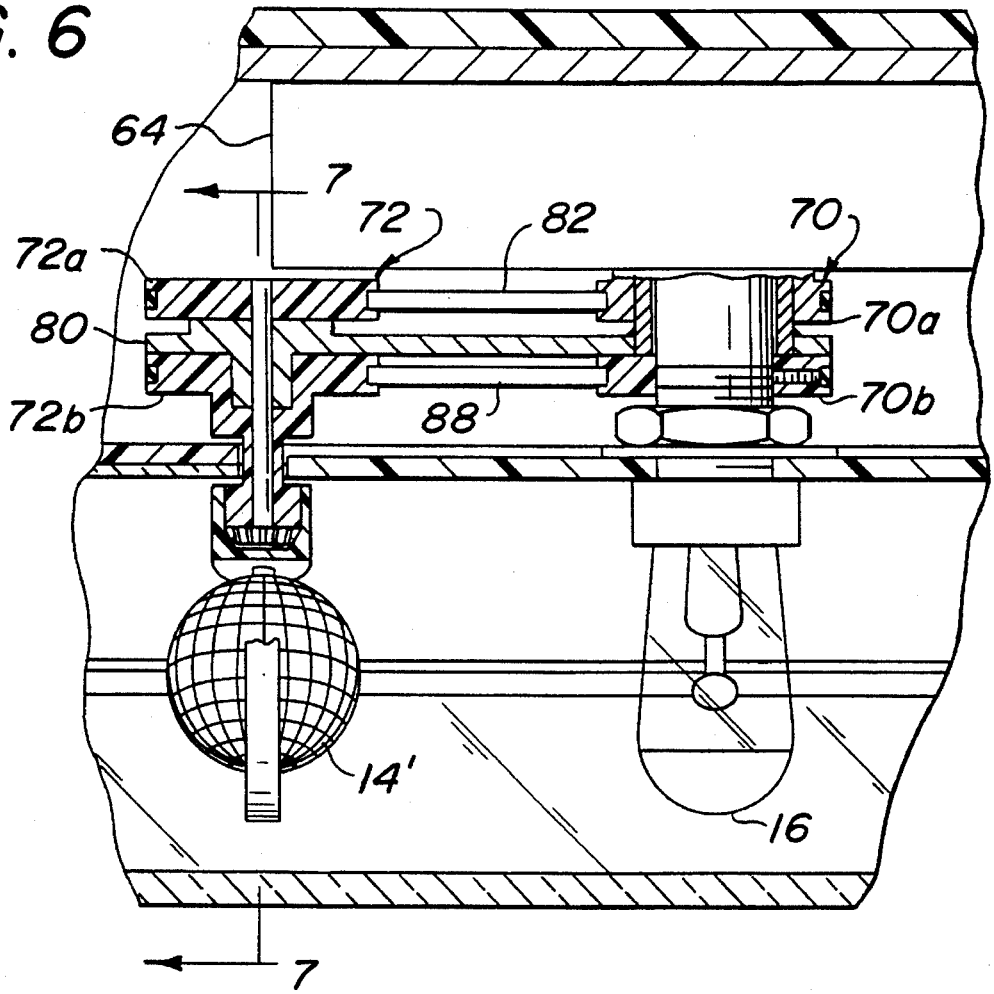
FIG. 6 is a broken away cross-sectional view taken along line 6—6 of FIG. 5.
Figure 7:
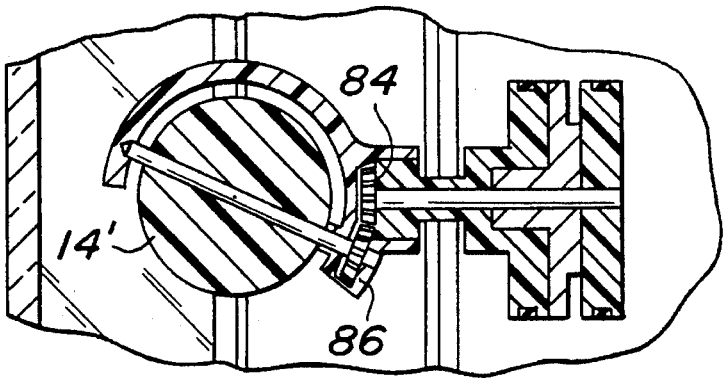
FIG. 7 is a broken away cross-sectional view taken along line 7—7 through the globe of FIG. 6.

Referring now to FIGS. 5, 6 and 7, there is shown another embodiment of an astronomical time clock utilizing a different drive arrangement for maintaining a predetermined tilt on globe 14. The embodiment illustrated in FIGS. 5, 6 and 7 utilizes a belt drive arrangement to rotate the globe and to adjust the tilt of globe 14 such that an angle of the axis of the globe of twenty-three and one half degrees (23½°) to the direction of arrow 17 (or the longitudinal axis of light bulb 16) is maintained as the globe rotates around the centrally disposed light 16 corresponding to the sun. The embodiment illustrated in FIGS. 5, 6 and 7 may be laid flat on a table whereas the previous embodiment utilizing a pivoted housing depending from a frame requires at least some degree of vertical mounting. For convenience, elements which are the same in the other embodiments, such as housing 24 are given the same numeral.

As may be best seen in FIG. 5, globe 14' representing the Earth is located approximately in the position of October, if viewed as in FIG. 1. Globe 14' is rotated on its axis and its predetermined tilt is maintained by belt drives 62 driven by main drive motor and gear box 64. Globe 14' is carried around light 16 representing the sun by arm 80.

As seen in FIGS. 5 and 6, the pulley drives 62 are comprised of motor drive pulleys 70 and Earth pulleys 72. Globe 14' and its pulleys 72 are mounted on arm 80 which rotates about the axis of light 16 once per year representing the Earth's rotation around the sun. Pulley **72*a* is caused to rotate once per day by means of the rotation of motor pulley 70*a* and drive belt 82. This represents the daily rotation of the Earth on its axis. This rotational force is transmitted to cause globe 14' to rotate on its axis via bevel gears 84 and 86, best seen in FIG. 7. Globe 14' is mounted at an angle of twenty-three and one half degrees (23½°) to the longitudinal axis of light 16 and is maintained at this predetermined angle by means of the rotation of pulley 72*b* which is driven by motor pulley 70*b* and drive pulley 88. The twenty-three and one half degree (23½°) tilt of globe 14' (or globes 14 or 114) is maintained in all embodiments as a deviation from the direction of arrow 17 in the direction of arrow 19 in an amount of about twenty-three and one half degrees (23½°). When the clock is in a vertical position, this would be an upwardly direction. In this manner, a positive drive maintains the axis of globe 14' at a predetermined angle with respect to the longitudinal axis of light 16**, representing the tilt of the Earth which results in the seasons experienced in the northern and southern hemispheres. This drive mechanism is independent of the orientation of the clock.

Figure 8:
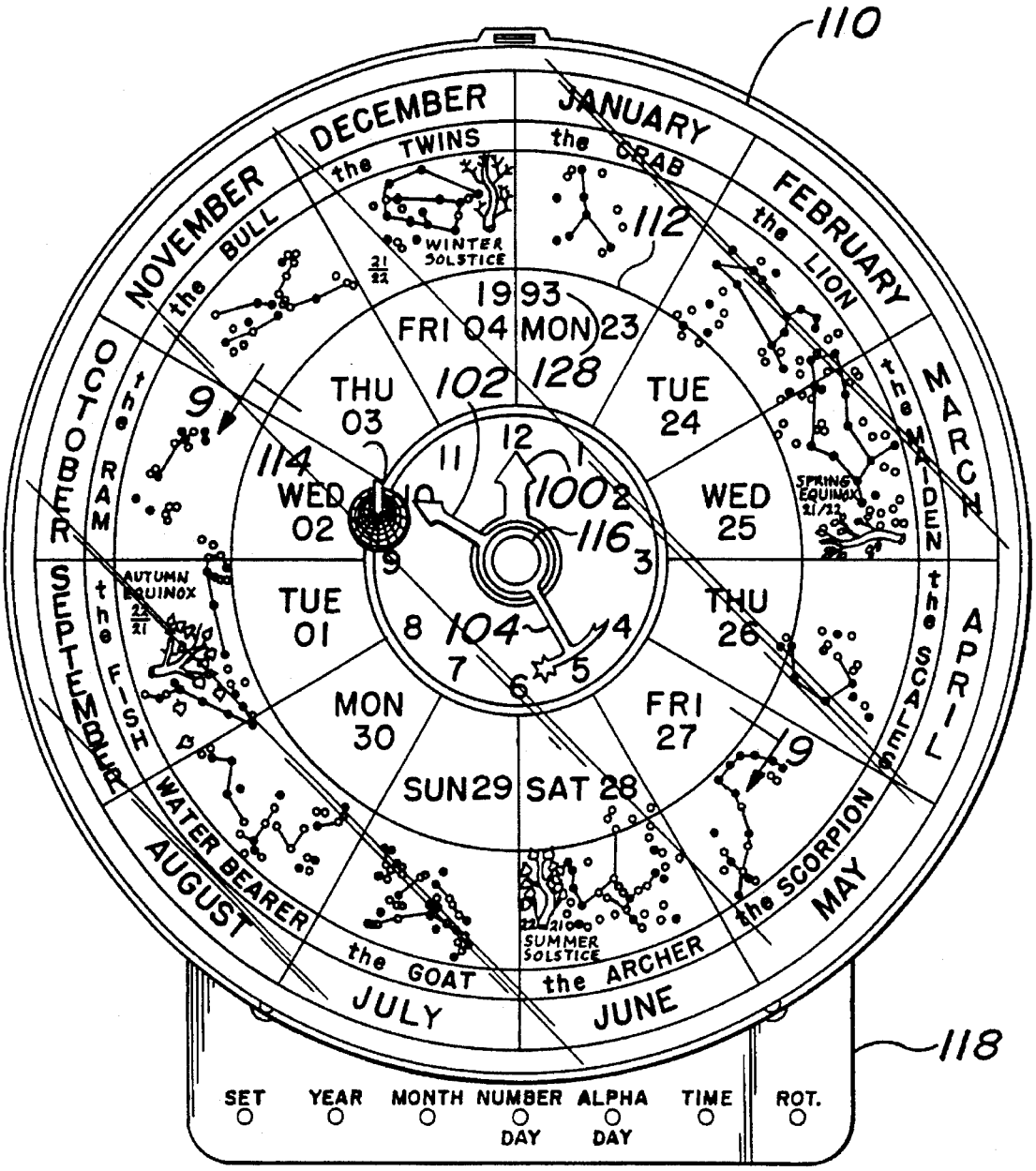
FIG. 8 is a front elevation view of another embodiment of an astronomical time clock utilizing hands to display the time.
Figure 9:
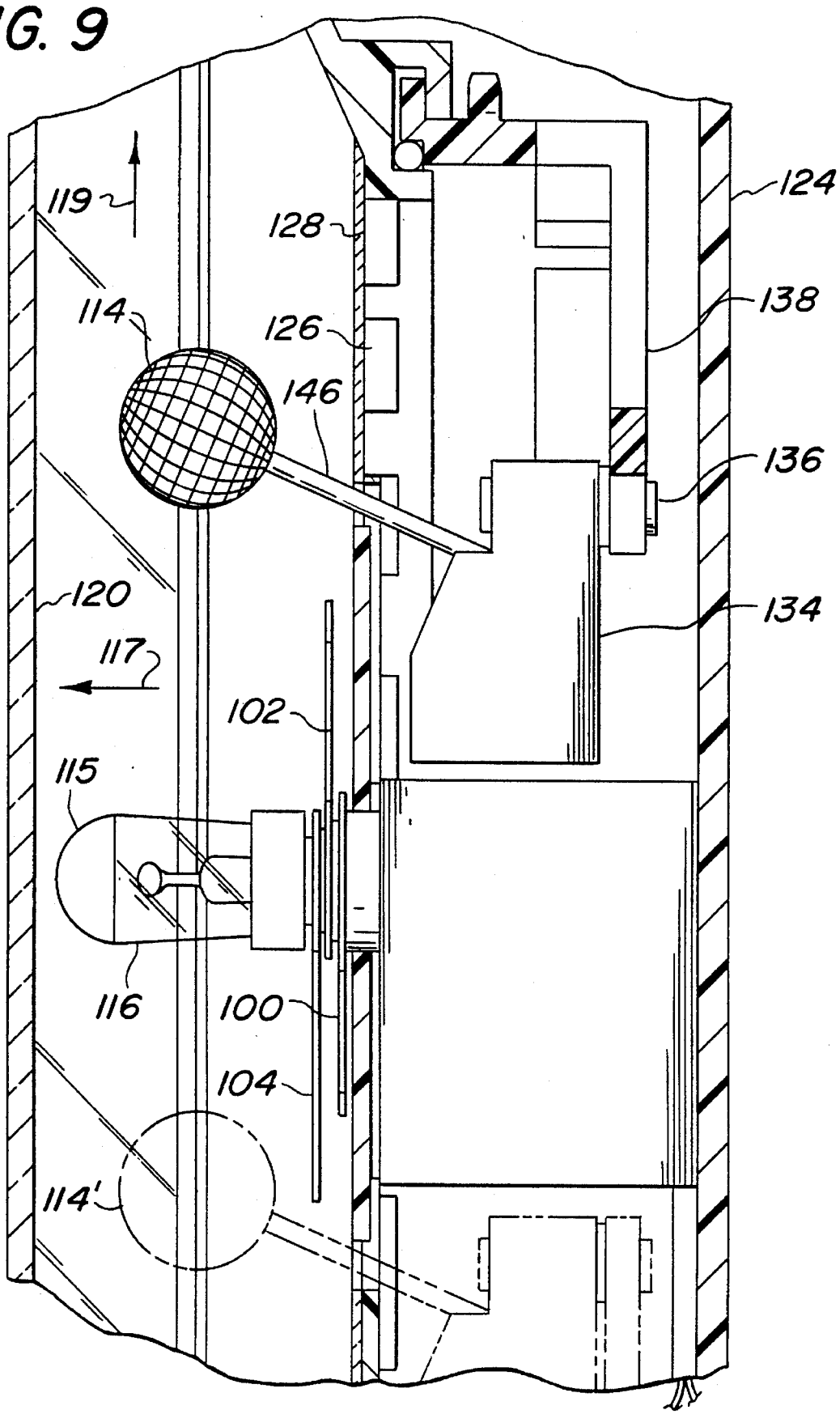
FIG. 9 is a broken away cross-sectional view taken along line 9—9 of FIG. 8.

Referring now to FIGS. 8 and 9, there is shown another embodiment of an astronomical time clock in accordance with the present invention which is similar to that described with respect to the embodiments illustrated in FIGS. 1 through 7 except that it utilizes clock hands to display the time, and accordingly, time is not displayed in the digital readouts. The embodiment illustrated in FIG. 9 illustrates a seasonal tilt maintenance system for the globe similar to that illustrated with respect to FIGS. 2 through 4, but it is understood that other drive arrangements may be utilized in connection with the rotation of the globe and the maintaining of the tilt, including those described with respect to FIGS. 5, 6 and 7.

Referring now specifically to FIGS. 8 and 9, there is shown an astronomical time clock 110 which contains a digital display in each of the twelve (12) sections of the clock face in a manner similar to that described with respect to FIG. 1. However, the digital displays, such as digital display 112 for the month of January contains only the alphabetical day of the week and the numerical day of the month readout. Since the time of the day is provided by clock hands 100, 102 and 104, there is no need to include a time of day display in the digital display in each of the twelve (12) segments. Only one digital display, the one for the current month, and the one in which the globe would be located, is made clearly visible. Although all of the digital displays are present, they may be mounted behind a translucent or colored glass, and the only one that would be clearly readable would be illuminated either by means of a light or energization of light emitting diodes in that particular display. Such an arrangement may be readily made by those skilled in the art, either electronically through the electronic control circuitry or by means of contact switches enabled by the support structure for the globe as it rotates through the various segments. A digital display of the year is provided at 128. Digital display 128 may be energized at all times, that is independent of the particular segment in which the globe is located.

As described with respect to FIG. 1, all of the segments may be labelled with the month of the year and a representation of a particular constellation visible in the night sky during that particular month may be illustrated in each segment. Other signs and information may also be included in each segment, including an indication of occurrences such as the Winter Solstice in December, the Spring Equinox in March and the like. This is similar to and was more fully describe with respect to FIG. 1.

It may also be pointed out that with respect to the tilt of the globe, it may be desirable to provided the Winter Solstice at December 21, as being in the true vertical position. However, as presently preferred, to provide a more uniform appearance, true vertical is the line of demarcation between December and January. However, this is a matter of design choice and this variation in the arrangement may be provided within the scope of the present invention with respect to all of the embodiments disclosed and described herein.

As referred to above, clock hands 100, 102 and 104 provide a display of the time. Clock hand 100 is the hand that indicates the hour of the day, clock hand 102 is the hand that indicates the minute of the hour and clock hand 104 is the second or sweep hand. The second or sweep hand 104 is optional, and may preferably be provided with a display as shown, such as a representation of a comet. As described with respect to any of the previous embodiments, globe 114 representing the Earth is caused to rotate around a centrally disposed light 116 representing the sun. As described previously, globe 114 is provided with the typical markings and displays of a geographical globe including the continents and oceans.

As described with respect to the previous embodiments, the embodiment of FIGS. 8 and 9 may be provided with a control panel 118. One suitable arrangement of a control panel is as illustrated at 118 in FIG. 8, as well as 18 in FIG. 1, wherein there is a set button which is depressed during the setting of a particular control button, such as the year button, the month button, the number of the day of the month, the alphabetical day of the week or the time of the day. The time of the day button may be optional in this embodiment as the hands may be physically rotated by opening the front cover glass 120. The "ROT" button stands for the rotation button which would be utilized to rotate globe 114 to an appropriate rotational position corresponding to the portion of the globe facing the sun for the particular time zone in which the viewer or user of the clock is located. For example, at twelve noon on a particular day, the rotation button would be depressed until the users location on globe 114 was directly facing light 116 which represents the sun. Of course, the setting controls may be mounted in other locations than that illustrated in the embodiments shown in FIGS. 1 and 8, including the placing of the control buttons on the back of the clock and out of view.

Referring more specifically to FIG. 9, which is a broken away cross-sectional view similar to that shown in FIG. 2, wherein corresponding elements are similarly numbered in the one hundred (100) series. As may be seen in FIG. 9, the hour clock hand 100, the minute clock hand 102 and the second or sweep hand 104 rotate around central light 116. Centrally disposed light 116 is provided with a shield or suitable at least partially light opaque cover 115 to prevent light emission into the eyes of the viewer, that is it prevents light emission in a direction perpendicular to the clock face, that is it prevents light emission in the direction of arrow 117.

Any of the various arrangements described for rotating globe 114 and for maintaining the predetermined angle of tilt as illustrated in FIG. 9 may be utilized. The angle of tilt of globe 114 is the angle that axis 146 forms with respect to the direction of arrow 117, and is preferably approximately twenty-three and one half degrees (23½°) in the direction of arrow 119. Arrow 117 may also be referred to as being in the direction of the longitudinal axis of the centrally disposed light.

As more fully described with respect to the previous embodiments, pivoted housing 134 is caused to depend in a vertical direction by gravity from pivot pin 136. As more fully described previously, pivot pin 136 is carried by suspension frame 138. Suspension frame 138 is caused to rotate once per year by a gear drive mechanism similar to that as described with respect to FIG. 2. Digital display 126 provides a readout of the day of the week and the day of the month and digital display 128 provides a readout of the year.

In view of the above, the present invention may be embodied in other specific forms without departing from the spirit or essential attributes thereof and, accordingly, reference should be made to the appended claims, rather than to the foregoing specification as indicating the scope of the invention.

I claim:

1. A time clock, comprising:

a clock face, said clock face being divided into twelve segments representing the months of the year;

means for displaying the time of day;

a globe representing the Earth rotatably positioned by a drive means in the segment representing the current month;

a light positioned substantially in the center of said clock face; and means for rotating said globe on its axis so that approximately half of said globe is illuminated by said light.

2. A time clock in accordance with claim 1, wherein each segment of said clock face is provided with a representation of a constellation usually visible in the night sky during the month represented by that segment.

3. A time clock in accordance with claim 1, wherein said light is provided with a shield to reduce light emission in a direction perpendicular to the clock face.

4. A time clock in accordance with claim 1, wherein said means for displaying the time of day is a digital display.

5. A time clock in accordance with claim 1, wherein said means for displaying the time of day includes rotating hands.

6. A time clock in accordance with claim 5, including a second hand having a representation of a comet on its rotating tip.

7. A time clock in accordance with claim 1, wherein said means for displaying the time of day includes a digital display in each segment with the digital display in the segment for the current month being the one made visible.

8. A time clock in accordance with claim 7, wherein said one digital display is made visible by illumination.

9. A time clock in accordance with claim 1, wherein said globe is synchronized with said means for displaying the time of day such that the proper portion of the globe is illuminated representing daylight.

10. A time clock in accordance with claim 1, wherein said axis of said globe is tilted to correspond to the seasons.

11. A time clock in accordance with claim 1, wherein means is provided to maintain said globe at a predetermined tilt with respect to said light as said globe travels around said light representative of the tilt of the Earth's axis with respect to the sun.

12. A time clock, comprising:

a clock face, said clock face being divided into twelve segments representing the months of the year;

means for displaying the time of the day;

a digital display in each of said twelve segments for displaying information, said information including at least some information relative to the day; and means for making visible only the digital display in the segment for the current month.

13. A time clock in accordance with claim 12, including a globe representing the Earth rotatably positioned by a drive means in the segment representing the current month.

14. A time clock in accordance with claim 13, including a light positioned substantially in the center of the clock face.

15. A time clock in accordance with claim 14, including means for rotating said globe on its axis so that approximately one half of said globe is illuminated by said light.

16. A time clock in accordance with claim 12, wherein each segment of said clock face is provided with a representation of a constellation usually visible in the night sky during the month represented by that segment.

17. A time clock in accordance with claim 12, wherein said light is provided with a shield to reduce light emission in a direction perpendicular to the clock face.

18. A time clock in accordance with claim 12, wherein said means for displaying the time of day is a digital display.

19. A time clock in accordance with claim 12, wherein said means for displaying the time of day includes rotating hands.

20. A time clock in accordance with claim 19, including a second hand having a representation of a comet on its rotating tip.

21. A time clock in accordance with claim 12, wherein said means for displaying the time of day includes a digital readout in each of said digital displays in each segment.

22. A time clock in accordance with claim 12, wherein said means for making visible the digital display is a means for illuminating the display in the segment of the current month.

23. A time clock in accordance with claim 12, wherein said globe is synchronized with said means for displaying the time of day such that the proper portion of the globe is illuminated representing day light.

24. A time clock in accordance with claim 12, wherein said axis of said globe is tilted to produce a seasons effect.

25. A time clock in accordance with claim 1, wherein means is provided to maintain said globe at a predetermined tilt with respect to said light as said globe travels around said light representative of the tilt of the Earth's axis with respect to the sun.

* * * * *